US010823347B2

(12) United States Patent
Snell et al.

(10) Patent No.: US 10,823,347 B2
(45) Date of Patent: Nov. 3, 2020

(54) MODULAR INDIRECT SUSPENDED/CEILING MOUNT FIXTURE

(75) Inventors: Nathan Snell, Raleigh, NC (US); James Michael Lay, Cary, NC (US); Nick Nguyen, Durham, NC (US); Patrick John O'Flaherty, Morrisville, NC (US)

(73) Assignee: Ideal Industries Lighting LLC, Sycamore, IL (US)

( * ) Notice: Subject to any disclaimer, the term of this patent is extended or adjusted under 35 U.S.C. 154(b) by 419 days.

(21) Appl. No.: 13/189,535

(22) Filed: Jul. 24, 2011

(65) Prior Publication Data

US 2013/0021792 A1 Jan. 24, 2013

(51) Int. Cl.
*F21S 4/28* (2016.01)
*F21V 23/00* (2015.01)
(Continued)

(52) U.S. Cl.
CPC . *F21S 4/28* (2016.01); *F21S 8/06* (2013.01); *F21V 7/0008* (2013.01); *F21V 7/0016* (2013.01); *F21V 7/24* (2018.02); *F21V 7/28* (2018.02); *F21V 15/01* (2013.01); *F21V 15/013* (2013.01); *F21V 15/015* (2013.01); *F21V 21/005* (2013.01); *F21V 23/002* (2013.01); *F21V 23/007* (2013.01); *F21V 29/70* (2015.01);
(Continued)

(58) Field of Classification Search
CPC ..... F21V 29/00
USPC ..... 362/249.01, 296.01, 341, 345, 370, 373, 362/404, 406, 218, 408
See application file for complete search history.

(56) References Cited

U.S. PATENT DOCUMENTS

D85,382 S 10/1931 Guth ..... D26/24
2,356,654 A 8/1944 Cullman ..... 200/84 C
(Continued)

FOREIGN PATENT DOCUMENTS

CN 1762061 4/2006
CN 1934389 3/2007
(Continued)

OTHER PUBLICATIONS

US Publication No. US 2007/0115671, date: May 24, 2007 to Roberts et al.
(Continued)

*Primary Examiner* — Sharon E Payne
(74) *Attorney, Agent, or Firm* — Myers Bigel, P.A.

(57) ABSTRACT

A modular troffer-style fixture particularly well-suited for use with solid state light sources. The fixture comprises a reflector that includes parallel rails running along its length, providing a mount mechanism and structural support. An exposed heat sink is disposed proximate to the reflector. The portion of the heat sink facing the reflector functions as a mount surface for the light sources. The heat sink is hollow through the center in the longitudinal direction. The hollow portion defines a conduit through which electrical conductors can be run to power light emitters. One or more light sources disposed along the heat sink mount surface emit light toward the reflector where it can be mixed and/or shaped before it is emitted from the troffer as useful light. End caps are arranged at both ends of the reflector and heat sink, allowing for the easy connection of multiple units in a serial arrangement.

42 Claims, 5 Drawing Sheets

(51) Int. Cl.

| | |
|---|---|
| ***F21S 8/00*** | (2006.01) |
| ***F21V 15/015*** | (2006.01) |
| ***F21V 7/00*** | (2006.01) |
| ***F21V 21/005*** | (2006.01) |
| ***F21S 8/06*** | (2006.01) |
| ***F21V 15/01*** | (2006.01) |
| ***F21V 29/70*** | (2015.01) |
| ***F21V 7/24*** | (2018.01) |
| ***F21V 7/28*** | (2018.01) |
| *F21V 29/85* | (2015.01) |
| *F21S 2/00* | (2016.01) |
| *F21S 9/02* | (2006.01) |
| *F21S 8/04* | (2006.01) |
| *F21S 8/02* | (2006.01) |
| *F21Y 103/10* | (2016.01) |
| *F21Y 113/13* | (2016.01) |
| *F21Y 115/10* | (2016.01) |

(52) U.S. Cl.

CPC ..... *F21S 2/00* (2013.01); *F21S 8/026* (2013.01); *F21S 8/043* (2013.01); *F21S 8/063* (2013.01); *F21S 9/02* (2013.01); *F21V 29/85* (2015.01); *F21Y 2103/10* (2016.08); *F21Y 2113/13* (2016.08); *F21Y 2115/10* (2016.08)

(56) References Cited

U.S. PATENT DOCUMENTS

| | | | | |
|---|---|---|---|---|
| 3,381,124 | A | 4/1968 | Eisenberg | 362/354 |
| 3,743,826 | A | 7/1973 | Halfaker | |
| 3,790,774 | A | 2/1974 | Miller | |
| 4,939,627 | A * | 7/1990 | Herst et al. | 362/299 |
| 5,025,356 | A * | 6/1991 | Gawad | 362/221 |
| 5,526,190 | A | 6/1996 | Hubble, III | 347/102 |
| 5,823,663 | A | 10/1998 | Bell et al. | 362/362 |
| D407,473 | S | 3/1999 | Wimbock | D23/328 |
| 6,079,851 | A | 6/2000 | Altman | |
| 6,102,550 | A | 8/2000 | Edwards, Jr. | |
| 6,149,283 | A | 11/2000 | Conway et al. | 362/236 |
| 6,155,699 | A | 12/2000 | Miller et al. | 362/293 |
| 6,210,025 | B1 | 4/2001 | Schmidt et al. | 362/362 |
| 6,234,643 | B1 | 5/2001 | Lichon, Jr. | 362/147 |
| 6,402,347 | B1 | 6/2002 | Maas et al. | 362/294 |
| 6,443,598 | B1 | 9/2002 | Morgan | 362/342 |
| 6,523,974 | B2 | 2/2003 | Engel | 362/224 |
| 6,578,979 | B2 | 6/2003 | Truttmann-Battig | 362/92 |
| 6,598,998 | B2 | 7/2003 | West | 257/E33.073 |
| D496,121 | S | 9/2004 | Santoro | D26/74 |
| 6,871,983 | B2 * | 3/2005 | Jacob et al. | 362/364 |
| 6,948,838 | B2 | 9/2005 | Kunstler | 362/237 |
| 6,948,840 | B2 | 9/2005 | Grenda et al. | 362/555 |
| 6,951,415 | B2 | 10/2005 | Amano | 362/297 |
| 7,021,797 | B2 | 4/2006 | Minano et al. | 362/355 |
| 7,049,761 | B2 | 5/2006 | Timmermans et al. | 315/246 |
| 7,063,449 | B2 | 6/2006 | Ward | 345/102 |
| 7,111,969 | B2 | 9/2006 | Bottesch | 362/299 |
| 7,175,296 | B2 | 2/2007 | Cok | 362/147 |
| 7,213,940 | B1 | 5/2007 | Van De Ven et al. | 362/231 |
| 7,217,004 | B2 | 5/2007 | Park | 362/240 |
| 7,237,924 | B2 | 7/2007 | Martineau et al. | 362/231 |
| D556,358 | S | 11/2007 | Santoro | D26/74 |
| 7,338,182 | B1 * | 3/2008 | Hastings et al. | 362/150 |
| 7,341,358 | B2 | 3/2008 | Hsieh | 362/97.1 |
| 7,510,299 | B2 | 3/2009 | Timmermans et al. | 362/225 |
| 7,520,636 | B2 | 4/2009 | Van Der Poel | 362/290 |
| D593,246 | S | 5/2009 | Fowler et al. | D26/76 |
| 7,559,672 | B1 | 7/2009 | Parkyn et al. | 362/244 |
| 7,594,736 | B1 | 9/2009 | Kassay et al. | 362/223 |
| D604,446 | S | 11/2009 | Fowler et al. | D26/76 |
| 7,614,767 | B2 | 11/2009 | Zulim | |
| 7,618,157 | B1 * | 11/2009 | Galvez et al. | 362/294 |
| 7,618,160 | B2 | 11/2009 | Chinniah et al. | 362/326 |
| D608,932 | S | 1/2010 | Castelli | D26/76 |
| 7,654,688 | B2 | 2/2010 | Li | |
| 7,654,702 | B1 | 2/2010 | Ding et al. | 362/294 |
| 7,661,844 | B2 | 2/2010 | Sekiguchi et al. | 362/249 |
| D611,183 | S | 3/2010 | Duarte | D26/76 |
| 7,674,005 | B2 * | 3/2010 | Chung et al. | 362/223 |
| 7,686,470 | B2 | 3/2010 | Chiang | 362/147 |
| 7,686,484 | B2 | 3/2010 | Heiking et al. | 362/375 |
| 7,712,918 | B2 | 5/2010 | Siemiet et al. | 362/241 |
| 7,722,220 | B2 * | 5/2010 | Van De Ven | 362/294 |
| 7,722,227 | B2 | 5/2010 | Zhang et al. | 362/364 |
| D617,487 | S | 6/2010 | Fowler et al. | D26/76 |
| 7,768,192 | B2 | 8/2010 | Van De Ven et al. | 313/503 |
| 7,815,338 | B2 | 10/2010 | Siemiet et al. | 362/218 |
| 7,824,056 | B2 | 11/2010 | Madireddi et al. | 362/125 |
| 7,828,468 | B2 | 11/2010 | Mayfield et al. | 362/342 |
| 7,868,484 | B2 | 1/2011 | Groff et al. | 362/375 |
| D633,247 | S | 2/2011 | Kong et al. | D26/88 |
| 7,922,354 | B2 | 4/2011 | Everhart | 362/235 |
| 7,926,982 | B2 | 4/2011 | Liu | 362/294 |
| 7,959,332 | B2 | 6/2011 | Tickner | |
| 7,988,321 | B2 * | 8/2011 | Wung et al. | 362/218 |
| 7,988,335 | B2 | 8/2011 | Liu et al. | 362/294 |
| 7,991,257 | B1 | 8/2011 | Coleman | |
| 7,993,034 | B2 | 8/2011 | Wegner | 362/296.05 |
| 7,997,762 | B2 | 8/2011 | Wang et al. | 362/249 |
| 8,038,314 | B2 | 10/2011 | Ladewig | |
| 8,038,321 | B1 | 10/2011 | Franck et al. | 362/249.02 |
| 8,070,326 | B2 | 12/2011 | Lee | 362/307 |
| D653,376 | S | 1/2012 | Kong et al. | D26/76 |
| 8,092,043 | B2 | 1/2012 | Lin et al. | 362/249.02 |
| 8,092,049 | B2 | 1/2012 | Kinnune et al. | 362/294 |
| 8,096,671 | B1 | 1/2012 | Cronk | 362/147 |
| D657,488 | S | 4/2012 | Lown et al. | D26/120 |
| 8,162,504 | B2 * | 4/2012 | Zhang et al. | 362/217.05 |
| 8,186,855 | B2 * | 5/2012 | Wassel et al. | 362/373 |
| 8,197,086 | B2 | 6/2012 | Watanabe et al. | 362/218 |
| 8,201,968 | B2 | 6/2012 | Maxik et al. | |
| 8,215,799 | B2 * | 7/2012 | Vanden Eynden et al. | 362/294 |
| 8,246,219 | B2 | 8/2012 | Teng | 362/217.02 |
| 8,256,927 | B2 * | 9/2012 | Hu | F21V 29/83 362/218 |
| 8,287,160 | B2 | 10/2012 | Shen | |
| D670,849 | S | 11/2012 | Lay et al. | D26/74 |
| 8,317,354 | B2 * | 11/2012 | Gassner et al. | 362/147 |
| D676,848 | S | 2/2013 | Smith et al. | D26/74 |
| 8,410,514 | B2 | 4/2013 | Kim | 257/99 |
| D684,291 | S | 6/2013 | Goelz et al. | D26/74 |
| 8,480,252 | B2 | 7/2013 | Bertram et al. | 362/243 |
| 8,506,135 | B1 | 8/2013 | Oster | 362/373 |
| 8,523,383 | B1 | 9/2013 | Grigore | |
| 8,556,452 | B2 | 10/2013 | Simon | 362/217.07 |
| 8,591,058 | B2 | 11/2013 | Concepcion | 362/231 |
| 8,591,071 | B2 * | 11/2013 | Hochstein | 362/294 |
| 8,602,601 | B2 | 12/2013 | Khazi | |
| 8,616,723 | B2 | 12/2013 | Zhang | 362/218 |
| D698,975 | S | 2/2014 | Blessitt et al. | D26/74 |
| 8,641,243 | B1 | 2/2014 | Rashidi | 362/373 |
| D701,988 | S | 4/2014 | Clements | D26/74 |
| 8,696,154 | B2 | 4/2014 | Hutchens | 362/217.05 |
| 8,702,264 | B1 | 4/2014 | Rashidi | 362/147 |
| 8,764,244 | B2 | 7/2014 | Jeon | 362/218 |
| D714,988 | S | 10/2014 | Park et al. | D26/74 |
| D721,198 | S | 1/2015 | Glasbrenner | D26/76 |
| 9,010,956 | B1 | 4/2015 | Davis | |
| 9,052,075 | B2 | 6/2015 | Demuynck et al. | |
| 2003/0063476 | A1 | 4/2003 | English et al. | |
| 2004/0001344 | A1 * | 1/2004 | Hecht | F21V 7/005 362/555 |
| 2004/0085779 | A1 | 5/2004 | Pond et al. | 362/516 |
| 2004/0100796 | A1 | 5/2004 | Ward | |
| 2004/0240230 | A1 | 12/2004 | Kitajima | 362/558 |
| 2005/0180135 | A1 | 8/2005 | Mayer | 362/240 |
| 2005/0264716 | A1 | 12/2005 | Kim et al. | |
| 2005/0281023 | A1 | 12/2005 | Gould | 362/217.5 |
| 2006/0221611 | A1 | 10/2006 | Noh | 362/247 |
| 2006/0245208 | A1 | 11/2006 | Sakamoto | |
| 2006/0262521 | A1 * | 11/2006 | Piepgras et al. | 362/149 |
| 2006/0279671 | A1 | 12/2006 | Han | |

(56) References Cited

U.S. PATENT DOCUMENTS

| | | | | |
|---|---|---|---|---|
| 2006/0291206 | A1 | 12/2006 | Angelini et al. | 362/244 |
| 2007/0070625 | A1 | 3/2007 | Bang | 362/240 |
| 2007/0109779 | A1 | 5/2007 | Sekiguchi et al. | |
| 2007/0211457 | A1 | 9/2007 | Mayfield et al. | 362/223 |
| 2007/0253205 | A1 | 11/2007 | Welker | 362/373 |
| 2007/0279910 | A1 | 12/2007 | Lin | |
| 2007/0297181 | A1 | 12/2007 | Mayfield et al. | 362/342 |
| 2008/0019147 | A1 | 1/2008 | Erchak | 362/607 |
| 2008/0037284 | A1 | 2/2008 | Rudisill | 362/629 |
| 2008/0049422 | A1* | 2/2008 | Trenchard et al. | 362/238 |
| 2008/0232093 | A1 | 9/2008 | Kim | 362/147 |
| 2008/0278943 | A1 | 11/2008 | Van Der Poel | 362/240 |
| 2008/0303977 | A1 | 12/2008 | Sekiguchi | |
| 2009/0034247 | A1 | 2/2009 | Boyer | 362/225 |
| 2009/0073693 | A1 | 3/2009 | Nall | 362/249.02 |
| 2009/0161356 | A1 | 6/2009 | Negley et al. | 362/231 |
| 2009/0168439 | A1 | 7/2009 | Chiang | 362/404 |
| 2009/0196024 | A1 | 8/2009 | Heiking et al. | 362/150 |
| 2009/0237958 | A1 | 9/2009 | Kim | |
| 2009/0262543 | A1 | 10/2009 | Ho | 362/373 |
| 2009/0296388 | A1 | 12/2009 | Wu et al. | 362/235 |
| 2009/0310354 | A1 | 12/2009 | Zampini et al. | 362/235 |
| 2010/0039579 | A1 | 2/2010 | Park | |
| 2010/0061108 | A1 | 3/2010 | Zhang et al. | 362/364 |
| 2010/0097794 | A1 | 4/2010 | Teng et al. | 362/231 |
| 2010/0103678 | A1 | 4/2010 | Van de Ven et al. | 362/294 |
| 2010/0110679 | A1 | 5/2010 | Teng et al. | |
| 2010/0142202 | A1 | 6/2010 | Sugishita | |
| 2010/0172133 | A1 | 7/2010 | Lie | 362/235 |
| 2010/0177514 | A1 | 7/2010 | Liu | |
| 2010/0177532 | A1* | 7/2010 | Simon et al. | 362/555 |
| 2010/0188609 | A1 | 7/2010 | Matsuki et al. | |
| 2010/0253591 | A1 | 10/2010 | Hwu et al. | 345/1.3 |
| 2010/0254128 | A1 | 10/2010 | Pickard et al. | 362/231 |
| 2010/0254145 | A1 | 10/2010 | Yamaguchi | |
| 2010/0254146 | A1 | 10/2010 | McCanless | |
| 2010/0270903 | A1 | 10/2010 | Jao et al. | 313/46 |
| 2010/0271843 | A1 | 10/2010 | Holten et al. | 362/609 |
| 2010/0277905 | A1 | 11/2010 | Janik et al. | 362/235 |
| 2010/0277934 | A1 | 11/2010 | Oquendo, Jr. | 362/433 |
| 2010/0277952 | A1* | 11/2010 | Chien | F21S 9/02 362/641 |
| 2010/0295468 | A1* | 11/2010 | Pedersen et al. | 315/294 |
| 2010/0302778 | A1 | 12/2010 | Dabiet | |
| 2010/0327768 | A1 | 12/2010 | Kong et al. | 315/294 |
| 2011/0032714 | A1 | 2/2011 | Chang | 362/373 |
| 2011/0043132 | A1 | 2/2011 | Kim et al. | |
| 2011/0090671 | A1 | 4/2011 | Bertram et al. | 362/84 |
| 2011/0141722 | A1* | 6/2011 | Acampora et al. | 362/218 |
| 2011/0141734 | A1 | 6/2011 | Li | 362/235 |
| 2011/0156584 | A1 | 6/2011 | Kim | 315/32 |
| 2011/0164417 | A1 | 7/2011 | Huang | 362/235 |
| 2011/0175533 | A1 | 7/2011 | Homan | 315/130 |
| 2011/0199005 | A1 | 8/2011 | Bretschneider et al. | |
| 2011/0199769 | A1 | 8/2011 | Bretschneider et al. | |
| 2011/0222291 | A1 | 9/2011 | Peng | |
| 2011/0246146 | A1 | 10/2011 | Kauffman et al. | 703/2 |
| 2011/0255292 | A1 | 10/2011 | Shen | 362/311 |
| 2011/0267810 | A1* | 11/2011 | Higman et al. | 362/218 |
| 2011/0267823 | A1 | 11/2011 | Angelini et al. | 362/277 |
| 2011/0286225 | A1 | 11/2011 | Konishi | |
| 2011/0305024 | A1 | 12/2011 | Chang | 362/294 |
| 2012/0033420 | A1 | 2/2012 | Kim et al. | 362/235 |
| 2012/0038289 | A1 | 2/2012 | Jee et al. | 315/291 |
| 2012/0051041 | A1 | 3/2012 | Edmond et al. | 362/231 |
| 2012/0120658 | A1 | 5/2012 | Wilk | |
| 2012/0127714 | A1 | 5/2012 | Rehn | |
| 2012/0134146 | A1 | 5/2012 | Smith | 362/225 |
| 2012/0140442 | A1 | 6/2012 | Woo | 362/95 |
| 2012/0140461 | A1 | 6/2012 | Huang et al. | |
| 2012/0206926 | A9 | 8/2012 | Chou | |
| 2012/0320576 | A1 | 12/2012 | Wald | |
| 2013/0235568 | A1 | 9/2013 | Green et al. | 362/218 |
| 2013/0242550 | A1 | 9/2013 | Suen | |
| 2013/0258652 | A1 | 10/2013 | Hsieh | 362/225 |
| 2014/0265930 | A1 | 9/2014 | Harris | 315/307 |
| 2015/0016100 | A1 | 1/2015 | Ishii | 362/223 |

FOREIGN PATENT DOCUMENTS

| | | | | |
|---|---|---|---|---|
| CN | 1963289 | A | 5/2007 | |
| CN | 101188261 | | 5/2008 | |
| CN | 101660715 | | 3/2010 | |
| CN | 101776254 | | 7/2010 | |
| CN | 101776254 | A | 7/2010 | |
| CN | 101790660 | | 7/2010 | |
| CN | 101790660 | A | 7/2010 | |
| CN | 102072443 | | 5/2011 | |
| CN | 202580962 | | 12/2012 | |
| DE | 102007030186 | | 1/2009 | |
| DE | 102007030186 | A1 | 1/2009 | |
| DE | 202010001832 | | 7/2010 | |
| EP | 1298383 | | 4/2003 | |
| EP | 1298383 | A2 | 4/2003 | |
| EP | 1357335 | A2 | 10/2003 | |
| EP | 1653254 | | 3/2006 | |
| EP | 1737051 | | 12/2006 | |
| EP | 1847762 | | 10/2007 | |
| EP | 1847762 | A2 | 10/2007 | |
| EP | 1860467 | | 11/2007 | |
| EP | 2287520 | A2 | 2/2011 | |
| EP | 2290690 | A2 | 3/2011 | |
| EP | 2636945 | A2 | 9/2013 | |
| GB | 774198 | | 5/1957 | |
| GB | 774198 | A1 * | 5/1957 | F21V 17/00 |
| JP | 1069809 | | 3/1998 | |
| JP | 2002244027 | | 11/2002 | |
| JP | U3097327 | | 8/2003 | |
| JP | 2004140327 | | 5/2004 | |
| JP | 2004345615 | | 12/2004 | |
| JP | 2004345615 | A | 12/2004 | |
| JP | 2006173624 | | 6/2006 | |
| JP | 2008147044 | | 6/2008 | |
| JP | 3151501 | U | 6/2009 | |
| JP | 2009295577 | | 12/2009 | |
| JP | 2010103687 | | 5/2010 | |
| JP | 2011018571 | | 8/2011 | |
| JP | 2011018572 | | 8/2011 | |
| TW | 200524186 | | 7/2005 | |
| TW | 200524186 | A | 7/2005 | |
| TW | 200914759 | A | 4/2009 | |
| TW | 201018826 | | 5/2010 | |
| TW | 201018826 | A | 5/2010 | |
| WO | WO 03102467 | | 12/2003 | |
| WO | WO 2009030233 | | 3/2009 | |
| WO | WO 2009140761 | A1 | 11/2009 | |
| WO | WO 2009157999 | | 12/2009 | |
| WO | WO 2009157999 | A | 12/2009 | |
| WO | WO 2009157999 | A1 | 12/2009 | |
| WO | WO 2010024583 | | 3/2010 | |
| WO | WO 2010024583 | A2 | 3/2010 | |
| WO | WO 2010042216 | | 4/2010 | |
| WO | WO 2010042216 | A2 | 4/2010 | |
| WO | WO 2011074424 | A1 | 6/2011 | |
| WO | WO 2011096098 | A1 | 8/2011 | |
| WO | WO 2011098191 | | 8/2011 | |
| WO | WO 2011118991 | A2 | 9/2011 | |
| WO | WO 2011140353 | A2 | 11/2011 | |
| WO | WO 03102467 | | 12/2013 | |

OTHER PUBLICATIONS

US Publication No. US 2007/0115670, date: May 24, 2007 to Roberts et al.

US Publication No. US 2009/0323334, date: Dec. 31, 2009 to Roberts et al.

US Publication No. US 2009/0225543, date: Mar. 5, 2008 to Roberts et al.

U.S. Appl. No. 12/873,303, filed Aug. 31, 2010 to Edmond, et al.

Office Action from U.S. Appl. No. 29/387,171, dated May 2, 2012.

Response to OA from U.S. Appl. No. 29/387,171, filed Aug. 2, 2012.

(56) References Cited

OTHER PUBLICATIONS

Office Action from U.S. Appl. No. 12/961,385, dated Apr. 26, 2013.
Response to OA from U.S. Appl. No. 12/961,385, filed Jul. 24, 2013.
Office Action from U.S. Appl. No. 13/464,745, dated Jul. 16, 2013.
Office Action from U.S. Appl. No. 29/368,970, dated Jun. 19, 2012.
Office Action from U.S. Appl. No. 29/368,970, dated Aug. 24, 2012.
Response to OA from U.S. Appl. No. 29/368,970, filed Nov. 26, 2012.
International Search Report and Written Opinion from Appl. No. PCT/CN2013/072772, dated Dec. 19, 2013.
Office Action from U.S. Appl. No. 13/464,745, dated Feb. 12, 2014.
Office Action from U.S. Appl. No. 13/453,924, dated Feb. 19, 2014.
Office Action from U.S. Appl. No. 13/341,741, dated Jan. 14, 2014.
Office Action from U.S. Appl. No. 13/370,252, dated Dec. 20, 2013.
International Search Report and Written Opinion from PCT Application No. PCT/US2013/021053, dated Apr. 17, 2013.
Final Rejection issued in Korean Design Appl. No. 30-2011-0038114, dated Jun. 14, 2013.
Final Rejection issued in Korean Design Appl. No 30-2011-0038115, dated Jun. 14, 2013.
Final Reection issued in Korean Design Appl. No. 30-2011-0038116, dated Jun. 17, 2013.
International Search Report and Written Opinion from PCT Patent Appl. No. PCT/US2013/035668, dated Jul. 12, 2013.
International Search Report and Written Opinion for PCT Application No. PCT/US2011/062396, dated Jul. 13, 2012.
Notice to Submit a Response from Korean Patent Application No. 30-2011-0038115, dated Dec. 12, 2012.
Notice to Submit a Response from Korean Patent Application No. 30-2011-0038116, dated Dec. 12, 2012.
International Search Report and Written Opinion for Patent Application No. PCT/US2011/001517, dated Feb. 27, 2012.
International Search Report and Written Opinion from PCT/US2013/049225, dated Oct. 24, 2013.
Office Action from Japanese Design Patent Application No. 2011-18570.
Reason for Rejection from Japanese Design Patent Application No. 2011-18571.
Reason for Rejection from Japanese Design Patent Application No. 2011-18572.
Office Action from U.S. Appl. No. 13/429,080, dated Apr. 18, 2014.
Office Action from U.S. Appl. No. 12/961,385, dated Mar. 11, 2014.
Search Report and Written Opinion from PCT Patent Appl. No. PCT/US2012/047084, dated Feb. 27, 2013.
Search Report and Written Opinion from PCT Patent Appl. No. PCT/US2012/071800, dated Mar. 25, 2013.
Preliminary Report and Written Opinion from PCT appl. No. PCT/US2012/047084, dated Feb. 6, 2014.
International Preliminary Report on Patentabiliby from PCT/US2012/071800 dated Jul. 10, 2014.
Office Action from U.S. Appl. No. 13/453,924, dated Jun. 25, 2014.
Office Action from U.S. Appl. No. 13/443,630, dated Jul. 1, 2014.
Office Action from U.S. Appl. No. 13/464,745, dated Jul. 16, 2014.
International Preliminary Report on Patentability and Written Opinion from PCT/US2013/021053, dated Aug. 21, 2014.
Reasons for Rejection from Japanese Patent Appl. No. 2013-543207, dated May 20, 2014.
First Office Action from Chinese Patent Appl No. 2011800529984, dated May 4, 2014.
Office Action from U.S. Appl. No. 13/544,662, dated May 5, 2014.
Office Action from U.S. Appl. No. 13/844,431, dated May 15, 2014.
Office Action from U.S. Appl. No. 13/341,741, dated Jun. 6, 2014.
Office Action from U.S. Appl. No. 13/442,746, dated Sep. 15, 2014.
Office Action from U.S. Appl. No. 13/429,080, dated Sep. 16, 2014.
Office Action from U.S. Appl. No. 13/844,431, dated Oct. 10, 2014.
Office Action from U.S. Appl. No. 13/443,630, dated Oct. 10, 2014.
Office Action from U.S. Appl. No. 13/368,217, dated Oct. 22, 2014.
Office Action from U.S. Appl. No. 12/961,385, dated Nov. 6, 2014.
Office Action from U.S. Appl. No. 13/453,924, dated Nov. 7, 2014.
Decision of Rejection from Japanese Appl. No. 2013-543207, dated Nov. 25, 2014.
Office Action from Mexican Appl. No. 100881, dated Nov. 28, 2014.
Grant Notice from European Appl No. 13701525.1-1757, dated Nov. 24, 2014.
Preliminary Report on Patentability from PCT/US2013/035668, dated Oct. 14, 2014.
Second Office Action and Search Report from Chinese Appl. No. 2011800529984, dated Dec. 26, 2014.
Grant Notice from European Appl. No. 13701525.1, dated Nov. 19, 2014.
International Report and Written Opinion from PCT/US2013/049225, dated Jan. 22, 2015.
Office Action from U.S. Appl. No. 13/828,348, dated Nov. 20, 2014.
Office Action from U.S. Appl. No. 12/873,303, dated Nov. 28, 2014.
Office Action from U.S. Appl. No. 13/464,745, dated Dec. 10, 2014.
Office Action from U.S. Appl. No. 13/341,741, dated Dec. 24, 2014.
First Official Action from European Patent Appl. No. 12 743 003.1-1757, dated Jan. 16, 2015.
Office Action from U.S. Appl. No. 13/787,727, dated Jan. 29, 2015.
Office Action from U.S. Appl. No. 13/429,080, dated Feb. 18, 2015.
Office Action from U.S. Appl. No. 13/453,924, dated Mar. 10, 2015.
First Office Action from Chinese Patent Appl. No. 2012800369142, dated Mar. 26, 2015.
Office Action from U.S. Appl. No. 13/464,745, dated Apr. 2, 2015.
Office Action from U.S. Appl. No. 13/442,746, dated Apr. 28, 2015.
Office Action from U.S. Appl. No. 13/368,217, dated May 13, 2015.
Office Action from U.S. Appl. No. 13/828,348, dated May 27, 2015.
Office Action from U.S. Appl. No. 12/961,385, dated Nov. 27, 2015.
Office Action from U.S. Appl. No. 13/828,348, dated Nov. 4, 2015.
Office Action from U.S. Appl. No. 14/020,757, dated Nov. 24, 2014.
First Office Action from Chinese Patent Appl. No. 2011800588770, dated Sep. 25, 2015.
Notice of Completion of Pretrial Re-examination from Japanese Patent appl. No. 2013-543207, dated Jun. 30, 2015.
Pretrial Report from Japanese Appl. No. 2013-543207, dated Jun. 19, 2015.
Decision of Rejection from Chinese Patent Appl. No. 201180052998.4, dated Jul. 16, 2015.
Office Action from U.S. Appl. No. 12/873,303, dated Jun. 22, 2015.
Response to OA from U.S. Appl. No. 12/873,303, filed Aug. 21, 2015.
Office Action from U.S. Appl. No. 13/341,741, dated Jun. 22, 2015.
Office Action from U.S. Appl. No. 13/443,630, dated Jun. 23, 2015.
Response to OA from U.S. Appl. No. 13/443,630, filed Aug. 21, 2015.
Office Action from U.S. Appl. No. 13/453,924, dated Jul. 21, 2015.
Office Action from U.S. Appl. No. 13/442,746, dated Jul. 27, 2015.
Office Action from U.S. Appl. No. 14/020,757, dated Aug. 3, 2015.
Office Action from U.S. Appl. No. 13/429,080, dated Sep. 1, 2015.
Office Action from U.S. Appl. No. 14/716,480, dated Sep. 24, 2015.
Office Action from U.S. Appl. No. 14/170,627, dated Oct. 5, 2015.
Office Action from U.S. Appl. No. 13/368,217, dated Oct. 8, 2015.
Office Action from U.S. Appl. No. 13/464,745, dated Oct. 8, 2015.
Office Action from U.S. Appl. No. 29/466,391, dated Oct. 14, 2015.
Office Action for U.S. Appl. No. 13/828,348; dated Jun. 2, 2016.
Notice of Reason for Rejection for Japanese Appl. No. 2013-543207; dated May 24, 2016.
Office Action for U.S. Appl. No. 14/020,757; dated Jul. 19, 2016.
Examination Report from Taiwan Application No. 100131021; dated Jul. 21, 2016.
Office Action for U.S. Appl. No. 14/716,480; dated Aug. 26, 2016.
Office Action for U.S. Appl. No. 13/464,745; dated Sep. 7, 2016.
European Summons for Oral Proceedings for Application No. 12743003.1; Dated Sep. 2, 2016.
Office Action from U.S. Appl. No. 13/464,745; dated Mar. 1, 2016.
Office Action from U.S. Appl. No. 14/716,480; dated Mar. 3, 2016.
Office Action from U.S. Appl. No. 13/368,217; dated Mar. 4, 2016.
Office Action from U.S. Appl. No. 14/020,757; dated Apr. 7, 2016.
Office Action from U.S. Appl. No. 29/466,391; dated May 10, 2016.
Second Office Action for Application No. 2011800588770; dated Mar. 29, 2016.

(56) References Cited

OTHER PUBLICATIONS

Office Action from U.S. Appl. No. 13/341,741; dated Jan. 8, 2016.
Office Action from U.S. Appl. No. 13/873,303; dated Feb. 2, 2016.
Examination from European Patent Appl. No. 12743003.1-1757, dated Jan. 8, 2016.
Examination Report from Taiwanese Patent Appl. No. 100131021, dated Jan. 5, 2016.
Notice of Reasons for Rejection from Japanese Patent Appl. No. 2013-543207, dated Feb. 2, 2016.
Examination from European Patent Appl. No. 13 701 525.1-1757, dated Feb. 3, 2016.
Office Action for U.S. Appl. No. 14/170,627; dated Jun. 4, 2018.
Office Action for U.S. Appl. No. 12/873,303; dated Jun. 19, 2018.
Office Action for U.S. Appl. No. 13/828,348; dated Jun. 26, 2018.
Offie Action for U.S. Appl. No. 14/716,480; dated Jul. 13, 2018.
Office Action for U.S. Appl. No. 14/721,806; dated Jul. 27, 2018.
Office Action for U.S. Appl. No. 14/225,327; dated Oct. 2, 2017.
Office Action for U.S. Appl. No. 14/721,806; dated Nov. 1, 2017.
Office Action for U.S. Appl. No. 14/170,627; dated Nov. 29, 2017.
Office Action for U.S. Appl. No. 13/464,745; dated Dec. 11, 2017.
Office Action for U.S. Appl. No. 14/716,480; dated Jan. 17, 2018.
Office Action for U.S. Appl. No. 14/225,327; dated Apr. 19, 2018.
Office Action for U.S. Appl. No. 13/464,745; dated May 2, 2018.
Foreign Office Action for European Application No. 11754767.9; dated May 7, 2018.
Office Action for U.S. Appl. No. 14/170,627; dated Jun. 16, 2017.
Office Action for U.S. Appl. No. 14/716,480; dated Jul. 5, 2017.
Office Action for U.S. Appl. No. 12/873,303; dated Aug. 9, 2017.
Office Action for U.S. Appl. No. 13/828,348; dated Sep. 1, 2017.
Notification of Reexamination for Chinese Application No. 2011800529984; dated Oct. 10, 2016.
Office Action for U.S. Appl. No. 13/828,348; dated Oct. 17, 2016.
Office Action for European Application No. 11754767.9; dated Oct. 31, 2016.
Office Action for U.S. Appl. No. 12/873,303; dated Nov. 25, 2016.
Notice of Allowance for Taiwan Application No. 100131021; dated Nov. 28, 2016.
Office Action for U.S. Appl. No. 13/368,217; dated Jan. 3, 2017.
Office Action for U.S. Appl. No. 14/716,480; dated Feb. 8, 2017.
Foreign Office Action for Japanese Application No. 2013-543207; dated Feb. 14, 2017.
Office Action for U.S. Appl. No. 14/225,327; dated Mar. 14, 2017.
Office Action for U.S. Appl. No. 13/464,745; dated Mar. 23, 2017.
Foreign Office Action for Chinese Application No. 2011800529984; dated Apr. 5, 2017.
Office Action for U.S. Appl. No. 14/721,806; dated Apr. 21, 2017.
Office Action for U.S. Appl. No. 13/443,630; dated May 18, 2017.
European Notice of Allowance for Application No. 12743003.1; dated Mar. 17, 2017.
Communication from European Patent Appl. No. 13701525.1-1757, dated Sep. 26, 2014.

* cited by examiner

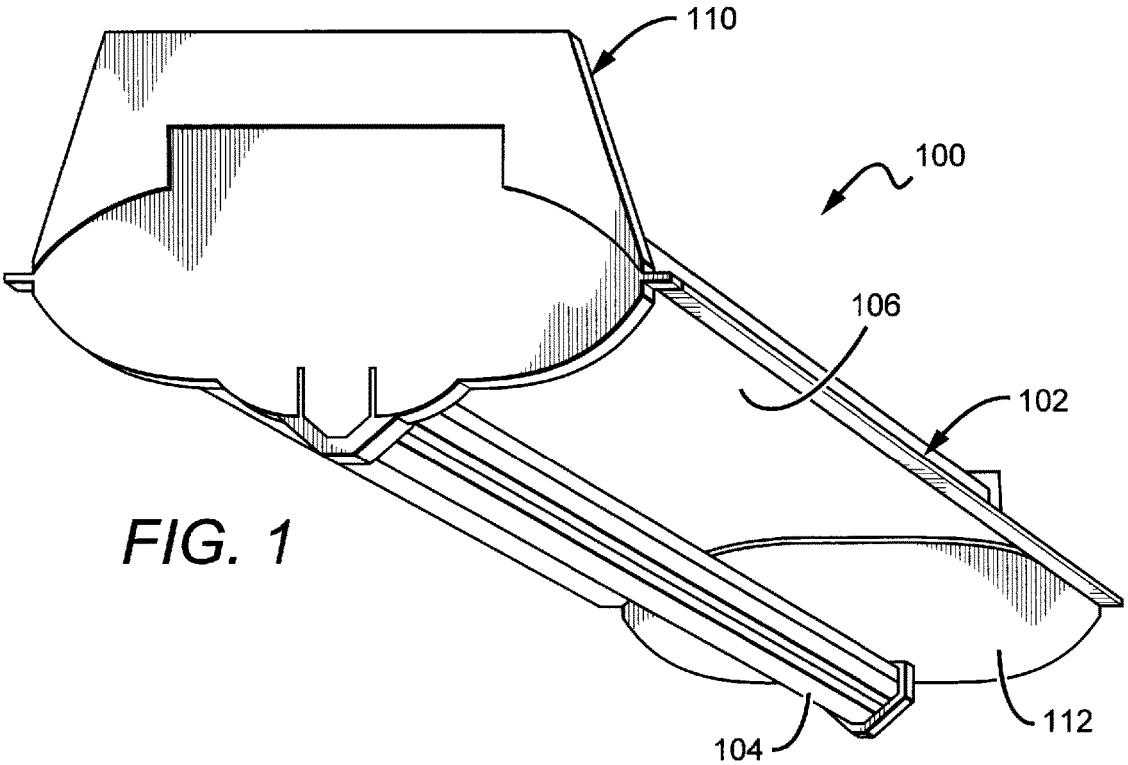
FIG. 1
FIG. 2
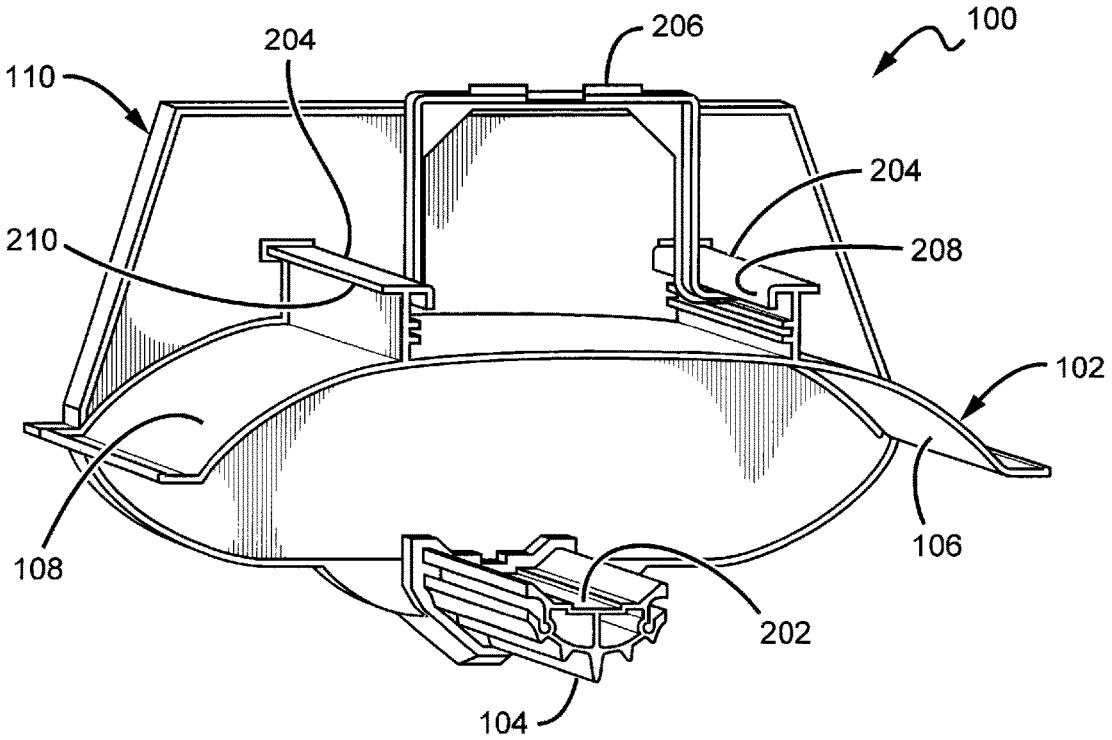

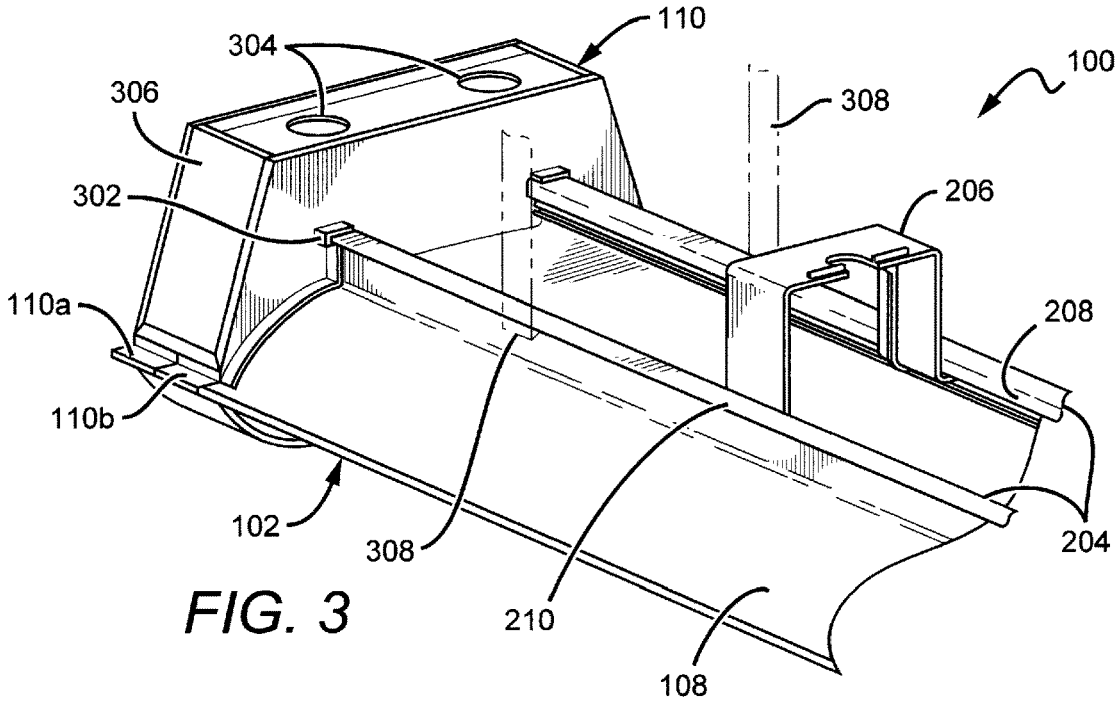
FIG. 3
FIG. 4
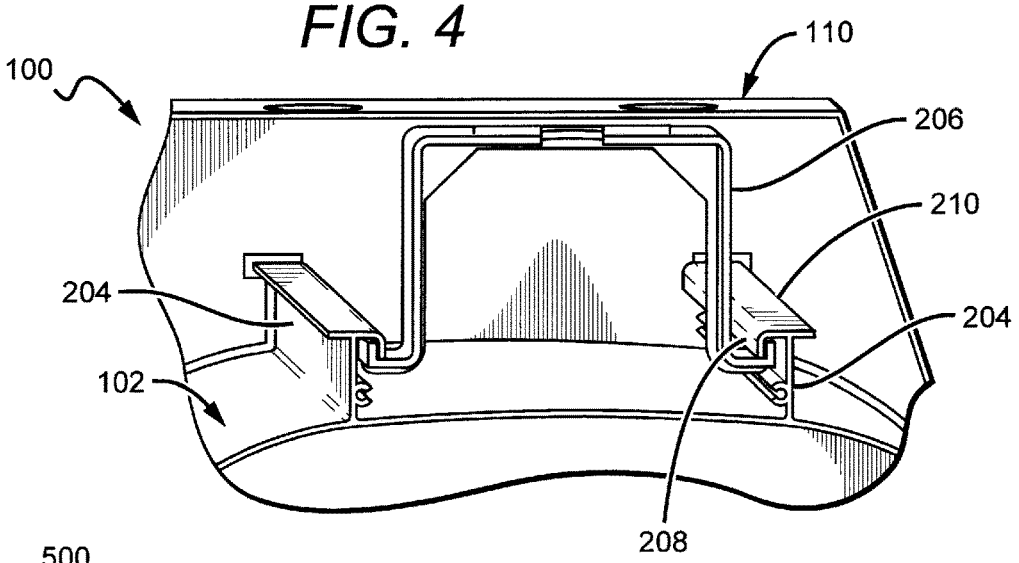
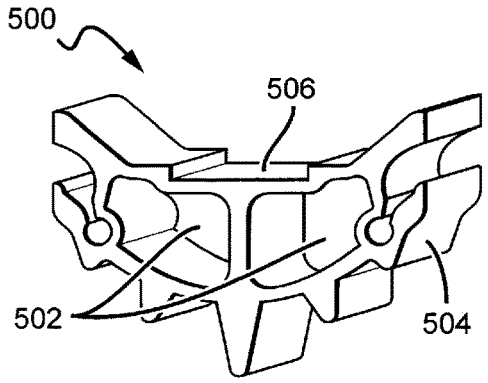
FIG. 5a
FIG. 5b
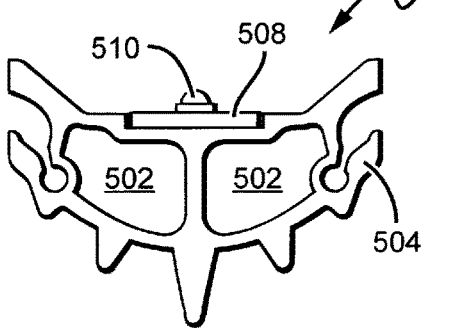

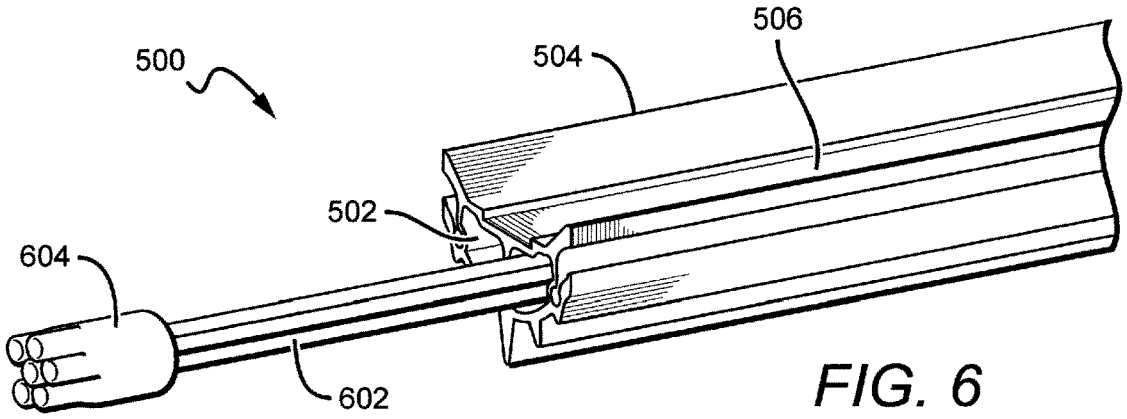
FIG. 6
FIG. 7a
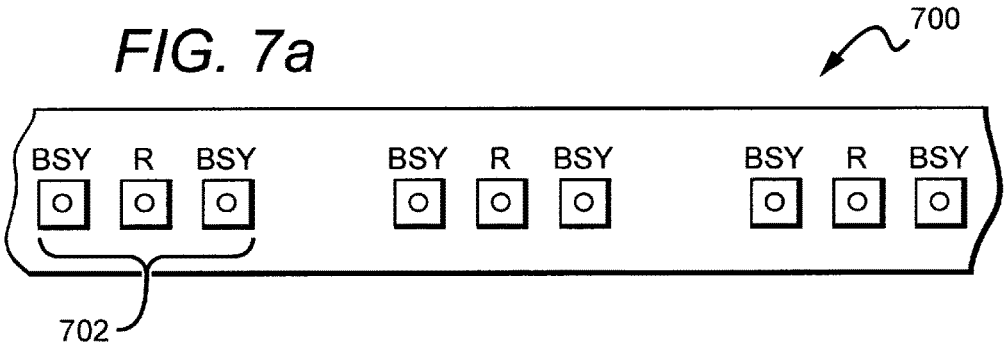
FIG. 7b
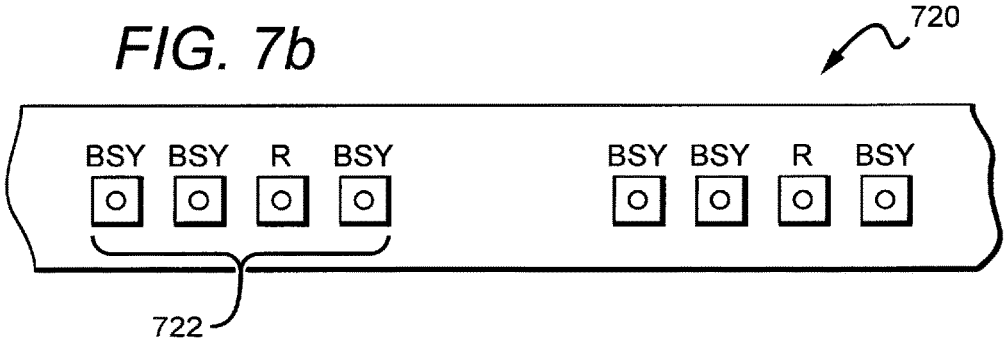
FIG. 7c
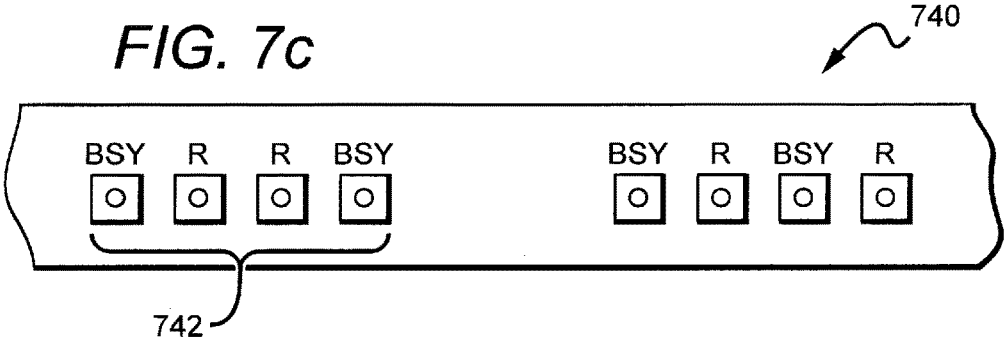

FIG. 10a
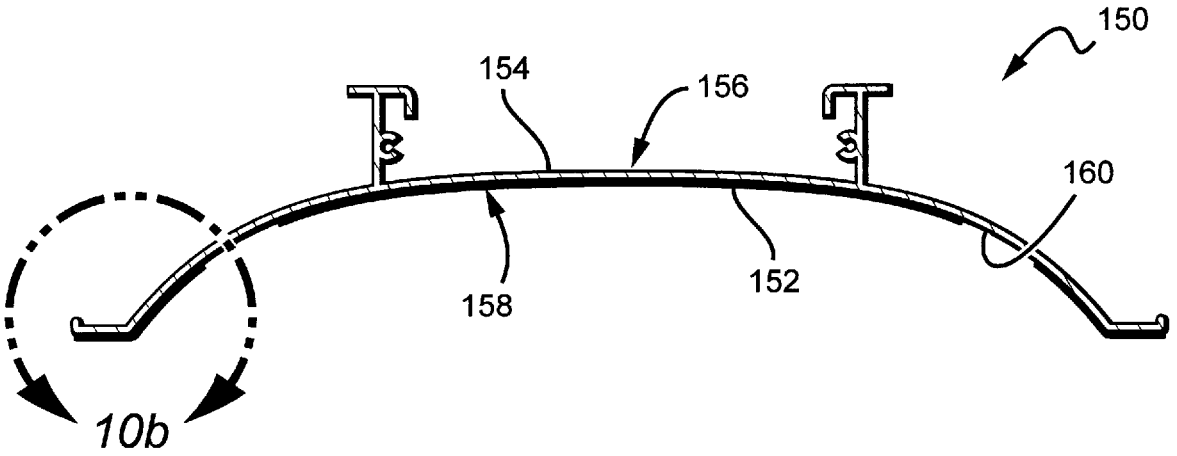
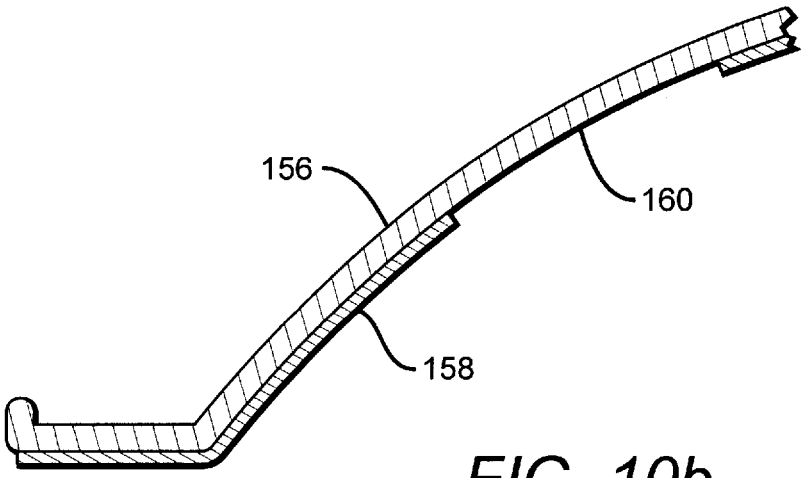
FIG. 10b

MODULAR INDIRECT SUSPENDED/CEILING MOUNT FIXTURE

BACKGROUND

Field

The invention relates to troffer-style lighting fixtures and, more particularly, to troffer-style fixtures that are well-suited for use with solid state lighting sources, such as light emitting diodes (LEDs).

Description of the Related Art

Troffer-style fixtures are ubiquitous in commercial office and industrial spaces throughout the world. In many instances these troffers house elongated fluorescent light bulbs that span the length of the troffer. Troffers may be mounted to or suspended from ceilings. Often the troffer may be recessed into the ceiling, with the back side of the troffer protruding into the plenum area above the ceiling. Typically, elements of the troffer on the back side dissipate heat generated by the light source into the plenum where air can be circulated to facilitate the cooling mechanism. U.S. Pat. No. 5,823,663 to Bell, et al. and U.S. Pat. No. 6,210,025 to Schmidt, et al. are examples of typical troffer-style fixtures.

More recently, with the advent of the efficient solid state lighting sources, these troffers have been used with LEDs, for example LEDs are solid state devices that convert electric energy to light and generally comprise one or more active regions of semiconductor material interposed between oppositely doped semiconductor layers. When a bias is applied across the doped layers, holes and electrons are injected into the active region where they recombine to generate light. Light is produced in the active region and emitted from surfaces of the LED.

LEDs have certain characteristics that make them desirable for many lighting applications that were previously the realm of incandescent or fluorescent lights. Incandescent lights are very energy-inefficient light sources with approximately ninety percent of the electricity they consume being released as heat rather than light. Fluorescent light bulbs are more energy efficient than incandescent light bulbs by a factor of about 10, but are still relatively inefficient. LEDs by contrast, can emit the same luminous flux as incandescent and fluorescent lights using a fraction of the energy.

In addition, LEDs can have a significantly longer operational lifetime. Incandescent light bulbs have relatively short lifetimes, with some having a lifetime in the range of about 750-1000 hours. Fluorescent bulbs can also have lifetimes longer than incandescent bulbs such as in the range of approximately 10,000-20,000 hours, but provide less desirable color reproduction. In comparison, LEDs can have lifetimes between 50,000 and 70,000 hours. The increased efficiency and extended lifetime of LEDs is attractive to many lighting suppliers and has resulted in their LED lights being used in place of conventional lighting in many different applications. It is predicted that further improvements will result in their general acceptance in more and more lighting applications. An increase in the adoption of LEDs in place of incandescent or fluorescent lighting would result in increased lighting efficiency and significant energy saving.

Other LED components or lamps have been developed that comprise an array of multiple LED packages mounted to a (PCB), substrate or submount. The array of LED packages can comprise groups of LED packages emitting different colors, and specular reflector systems to reflect light emitted by the LED chips. Some of these LED components are arranged to produce a white light combination of the light emitted by the different LED chips.

In order to generate a desired output color, it is sometimes necessary to mix colors of light which are more easily produced using common semiconductor systems. Of particular interest is the generation of white light for use in everyday lighting applications. Conventional LEDs cannot generate white light from their active layers; it must be produced from a combination of other colors. For example, blue emitting LEDs have been used to generate white light by surrounding the blue LED with a yellow phosphor, polymer or dye, with a typical phosphor being cerium-doped yttrium aluminum garnet (Ce:YAG). The surrounding phosphor material "downconverts" some of the blue light, changing it to yellow light. Some of the blue light passes through the phosphor without being changed while a substantial portion of the light is downconverted to yellow. The LED emits both blue and yellow light, which combine to yield white light.

In another known approach, light from a violet or ultraviolet emitting LED has been converted to white light by surrounding the LED with multicolor phosphors or dyes. Indeed, many other color combinations have been used to generate white light.

Some recent designs have incorporated an indirect lighting scheme in which the LEDs or other sources are aimed in a direction other than the intended emission direction. This may be done to encourage the light to interact with internal elements, such as diffusers, for example. One example of an indirect fixture can be found in U.S. Pat. No. 7,722,220 to Van de Ven which is commonly assigned with the present application.

Modern lighting applications often demand high power LEDs for increased brightness. High power LEDs can draw large currents, generating significant amounts of heat that must be managed. Many systems utilize heat sinks which must be in good thermal contact with the heat-generating light sources. Troffer-style fixtures generally dissipate heat from the back side of the fixture that extends into the plenum. This can present challenges as plenum space decreases in modern structures. Furthermore, the temperature in the plenum area is often several degrees warmer than the room environment below the ceiling, making it more difficult for the heat to escape into the plenum ambient.

SUMMARY

An embodiment of a lighting assembly comprises the following elements. An elongated heat sink is shaped to define a conduit running longitudinally through the interior of the heat sink. A reflector is proximate to the heat sink, the reflector comprising a surface facing the heat sink and a back surface. The heat sink and reflector are mountable to a first end cap.

An embodiment of a modular lighting assembly comprises the following elements. At least one lighting unit is capable of being connected to additional lighting units in an end-to-end serial arrangement. Each lighting unit comprises an elongated heat sink, a reflector proximate to the heat sink, a first end cap, and a second end cap. The heat sink and the reflector are mounted between the first end cap and the second end cap.

An embodiment of a lighting assembly comprises the following elements. An elongated heat sink comprises a mount surface. The heat sink is shaped to define a conduit running longitudinally through the interior of the heat sink. Light emitters are on said mount surface. An electrical conductor running through the heat sink conduit can provide power to said light emitters. A reflector comprises a surface facing toward the light emitters. First and second end caps comprise mount structures such that the heat sink and the reflector mount between the first and second end caps, the first end cap housing electronics for powering said light emitters.

BRIEF DESCRIPTION OF THE DRAWINGS

FIG. 1 is a perspective view of a lighting assembly according to an embodiment of the present invention.

FIG. 2 is a perspective view of a cut-away portion of a lighting assembly according to an embodiment of the present invention.

FIG. 3 is a perspective view of a portion of a lighting assembly according to an embodiment of the present invention.

FIG. 4 is another perspective view of a cut-away portion of a lighting assembly according to an embodiment of the present invention.

FIG. 5*a* is a perspective view of a cross-sectional portion of a heat sink that can be used in a lighting assembly according to an embodiment of the present invention.

FIG. 5*b* is a cross-sectional view of a heat sink that can be used in a lighting assembly according to an embodiment of the present invention.

FIG. 6 is a perspective view of an end portion of a heat sink that can be used in a lighting assembly according to an embodiment of the present invention.

FIGS. 7*a-c* are top plan views of portions of several light strips that may be used in lighting assemblies according to embodiments of the present invention.

FIG. 10*a* is a cross-sectional view of a reflector that may be used in lighting assemblies according to embodiments of the present invention.

FIG. 10*b* is a close-up view of a portion of a reflector that may be used in lighting assemblies according to embodiments of the present invention.

DETAILED DESCRIPTION

Figure 8:
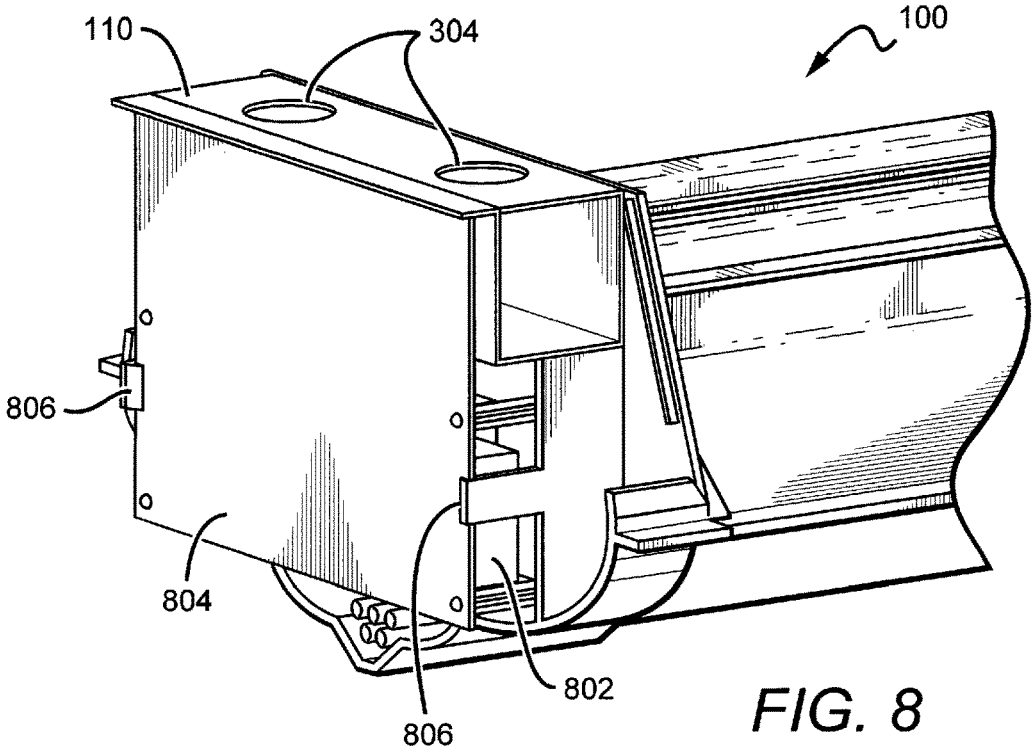
FIG. 8 is a perspective view of an end cap that can be used in a lighting assembly according to an embodiment of the present invention.

Embodiments of the present invention provide a modular troffer-style fixture that is particularly well-suited for use with solid state light sources, such as LEDs. The fixture comprises a reflector having a surface on one side and a back surface on the opposite side. The back surface includes parallel rails that run along the length of the reflector, providing a mount mechanism as well structural support to the reflector. To facilitate the dissipation of unwanted thermal energy away from the light sources, a heat sink is disposed proximate to the surface of the reflector. The portion of the heat sink facing the reflector functions as a mount surface for the light sources, creating an efficient thermal path from the sources to the ambient. The heat sink, which is exposed to the ambient room environment, is hollow through the center in the longitudinal direction. The hollow portion defines a conduit through which electrical conductors (e.g., wires) can be run to power light emitters. One or more light emitters disposed along the heat sink mount surface emit light toward the reflector where it can be mixed and/or shaped before it is emitted from the troffer as useful light. End caps are arranged at both ends of the reflector and heat sink. One of the end caps houses electronics for powering the light emitters. The end caps are constructed to allow for the easy connection of multiple units in a serial arrangement.

FIG. 1 is a perspective view of a lighting assembly 100 according to an embodiment of the present invention. The lighting assembly 100 is particularly well-suited for use as a fixture for solid state light emitters, such as LEDs or vertical cavity surface emitting lasers (VCSELs), for example. However, other kinds of light sources may also be used. A reflector 102 is disposed proximate to an elongated heat sink 104, both of which are described in detail herein. The reflector 102 comprises a surface 106 that faces toward the heat sink 104 and a back surface 108 (shown in FIG. 2) on the opposite side. First and second end caps 110, 112 are arranged at both ends of the reflector 102 and the heat sink 104 to maintain the distance between the two elements and provide the structural support for the assembly 100.

In this embodiment of the lighting assembly 100, the heat sink 104 is exposed to the ambient environment. This structure is advantageous for several reasons. For example, air temperature in a typical residential or commercial room is much cooler than the air above the fixture (or the ceiling if the fixture is mounted above the ceiling plane). The air beneath the fixture is cooler because the room environment must be comfortable for occupants; whereas in the space above the fixture, cooler air temperatures are much less important. Additionally, room air is normally circulated, either by occupants moving through the room or by air conditioning. The movement of air throughout the room helps to break the boundary layer, facilitating thermal dissipation from the heat sink 104. Also, in ceiling-mounted embodiments, a room-side heat sink configuration prevents improper installation of insulation on top of the heat sink as is possible with typical solid state lighting applications in which the heat sink is disposed on the ceiling-side. This guard against improper installation can eliminate a potential fire hazard.

FIG. 2 is a perspective view of a cut-away portion of the lighting assembly 100. The reflector 102 and heat sink 104 are mounted to the inside surface of the first end cap 110. In this particular embodiment, these elements are mounted using a snap-fit mechanism which provides reduced assembly time and cost. Other mounting means may also be used, such as pins, screws, adhesives, etc. The first end cap 110 maintains the desired spacing between the reflector 102 and the heat sink 104. The heat sink 104 comprises a mount surface 202 on which light emitters (e.g., LEDs) can be mounted. The mount surface 202 faces the surface 106 of the reflector 102. The emitters can be mounted such that they emit light toward the surface 106, or a certain portion thereof. The emitted light is then reflected off the surface 106 and out into the ambient as useful light.

The reflector 102 can be constructed from many different materials. In one embodiment, the reflector 102 comprises a material which allows the reflector 102 to be extruded for efficient, cost-effective production. Some acceptable materials include polycarbonates, such as Makrolon 6265X or FR6901 (commercially available from Bayer) or BFL4000 or BFL2000 (commercially available from Sabic). Many other materials may also be used to construct the reflector 102. Using an extrusion process for fabrication, the reflector 102 is easily scalable to accommodate lighting assemblies of varying length.

The surface 106 may be designed to have several different shapes to perform particular optical functions, such as color mixing and beam shaping, for example. Emitted light may be bounced off of one or more surfaces, including the surface 106. This has the effect of disassociating the emitted light from its initial emission angle. Uniformity typically improves with an increasing number of bounces, but each bounce has an associated optical loss. In some embodiments an intermediate diffusion mechanism (e.g., formed diffusers and textured lenses) may be used to mix the various colors of light.

The surface 106 should be highly reflective in the wavelength ranges of the light emitters. In some embodiments, the surface 106 may be 93% reflective or higher. In other embodiments it may be at least 95% reflective or at least 97% reflective.

The surface 106 may comprise many different materials. For many indoor lighting applications, it is desirable to present a uniform, soft light source without unpleasant glare, color striping, or hot spots. Thus, the surface 106 may comprise a diffuse white reflector such as a microcellular polyethylene terephthalate (MCPET) material or a Dupont/WhiteOptics material, for example. Other white diffuse reflective materials can also be used.

Diffuse reflective coatings have the inherent capability to mix light from solid state light sources having different spectra (i.e., different colors). These coatings are particularly well-suited for multi-source designs where two different spectra are mixed to produce a desired output color point. For example, LEDs emitting blue light may be used in combination with other sources of light, e.g., yellow light to yield a white light output. A diffuse reflective coating may eliminate the need for additional spatial color-mixing schemes that can introduce lossy elements into the system; although, in some embodiments it may be desirable to use a diffuse surface in combination with other diffusive elements. In some embodiments, the surface may be coated with a phosphor material that converts the wavelength of at least some of the light from the light emitting diodes to achieve a light output of the desired color point.

By using a diffuse white reflective material for the surface 106 and by positioning the light sources to emit light first toward the surface 106 several design goals are achieved. For example, the surface 106 performs a color-mixing function, effectively doubling the mixing distance and greatly increasing the surface area of the source. Additionally, the surface luminance is modified from bright, uncomfortable point sources to a much larger, softer diffuse reflection. A diffuse white material also provides a uniform luminous appearance in the output. Harsh surface luminance gradients (max/min ratios of 10:1 or greater) that would typically require significant effort and heavy diffusers to ameliorate in a traditional direct view optic can be managed with much less aggressive (and lower light loss) diffusers achieving max/min ratios of 5:1, 3:1, or even 2:1.

The surface 106 can comprise materials other than diffuse reflectors. In other embodiments, the surface 106 can comprise a specular reflective material or a material that is partially diffuse reflective and partially specular reflective. In some embodiments, it may be desirable to use a specular material in one area and a diffuse material in another area. For example, a semi-specular material may be used on the center region with a diffuse material used in the side regions to give a more directional reflection to the sides. Many combinations are possible.

The reflector back surface 108 comprises elongated rails 204 that run longitudinally along the reflector 102. The rails 204 perform important dual functions. They provide a mechanism by which the assembly 100 can be mounted to an external surface, such as a ceiling. At the same time, the rails 204 also provide structural support, preventing longitudinal bending along the length of the assembly 100 which allows longer reflector components to be used. The rails 204 may comprise features on the inner and outer surfaces, such as inner flanges 208 and outer flanges 210. The flanges 208, 210 may interface with external elements, such as mounting structures, for example, and may take many different shapes depending on the design of the structures used for mounting. The rails 204 may also comprise many other features necessary for mounting or other purposes.

In this particular embodiment, a U-shaped mount bracket 206 is connected to the inner flange 208. The outer flanges 210 may be used for alternate mounting configurations discussed herein. The mounting bracket 206 removably connects to the rails 204 using snap-fit or slide-fit mechanisms, for example. The mount bracket 206 can be used to mount the light assembly 100 to a surface, such as a ceiling, when the assembly is mounted by suspension. The mounting bracket 206 may be made of metal, plastic, or other materials that are strong enough to support the weight of the assembly 100.

FIG. 3 is another perspective view of a portion of the lighting assembly 100. In this embodiment, the reflector 102 is connected to the end cap 110 with a snap-fit interface 302. The heat sink 104 (not shown in FIG. 3) may also be connected to the end cap 110 with a snap-fit interface. The end cap 110 may comprise access holes 304 to allow for an electrical conductor to be fed down from a ceiling, for example, if the assembly 100 is to be powered from an external source. The assembly 100 may also be powered by a battery that can be stored inside the end cap 110, eliminating the need for an external power source. The end cap 110 can be constructed as two separate pieces 110*a*, 110*b* which can be joined using a snap-fit mechanism or screws, for example, so that the end cap can be disassembled for easy access to the electronics housed within. In other embodiments, the end cap pieces 110*a*, 110*b* can be joined using an adhesive, for example. The end cap 110 may also comprise a removable side cover 306 to provide access to internal components.

FIG. 3 also shows an alternate mounting means for the assembly 100. Hanging tongs 308 (shown in phantom) may be used to suspend the assembly 100 from a ceiling. Many buildings currently have this type of hanging mount system with the existing lighting fixtures used therein. Thus, the assembly 100 can be easily retrofit for installation in buildings that already have a mount system. In this particular embodiment, the reflector rails 204 are designed with inner and outer flanges 208, 210. Inner flanges 208 are designed to interface with a mount mechanism such as mounting bracket 206, for example. Outer flanges 210 are designed to interface with a mount mechanism such as hanging tongs 308, for example. It is understood that the reflector 102 can be designed to accommodate many different mounting structures and should not be limited to the exemplary embodiments shown herein.

FIG. 4 is another perspective view of a cut-away portion of the lighting assembly 100. In this embodiment, the mount bracket 206 hooks on to the underside of the inner flange 208 as shown. The mount bracket 206 may be connected to the inner flange 208 in many other ways as well.

FIG. 5*a* is a perspective view of a cross-sectional portion of a heat sink 500 that can be used in the lighting assembly 100. In this embodiment, the heat sink 500 is shaped to define two parallel longitudinal conduits 502 that run along the entire length of the heat sink body 504. The conduits 502 are designed to accommodate wires, cords, cables or other electrical conductors for providing power to light emitters (not shown). The conduits 502 should be large enough to carry the necessary power and signal cords. The heat sink 500 comprises a flat mount surface 506 on which light emitters can be mounted. The emitters can be mounted directly to the mount surface 506, or they can be disposed on a light strip which is then mounted to the mount surface 506 as discussed in more detail herein.

FIG. 5*b* is a cross-sectional view of the heat sink 500. A light strip 508 is shown disposed on the mount surface 506. As discussed in more detail herein, the light strip 506 comprises one or more light emitters 510 mounted thereto.

FIG. 6 shows a perspective view of an end portion of the heat sink 500. A cable 602 is shown passing through one of the conduits 502. The hollow heat sink structure provides advantages over traditional heat sink designs. For example, the heat sink 500 requires less material to construct, reducing overall weight and cost. The heat sink 500 also provides a wire way for the necessary power and signal cabling. This configuration eliminates the need for a separate wire way along the length of the assembly, which also reduces material and fabrication costs. In this embodiment, the cable 602 comprises a six-wire system that is used to power and control the light emitters. The cable can comprise several types of connection adapters. This embodiment comprises cylindrical cable connectors 604 for easy connection to another adjacent assembly in an end-to-end serial (i.e., daisy chain) configuration, as discussed in more detail herein. Many different cabling and connection schemes are possible.

The heat sink 500 can be constructed using many different thermally conductive materials. For example, the heat sink 500 may comprise an aluminum body 504. Similarly as the reflector 102, the heat sink 500 can be extruded for efficient, cost-effective production and convenient scalability.

The heat sink mount surface 506 provides a substantially flat area on which one or more light sources can be mounted. In some embodiments, the light sources will be pre-mounted on light strips. FIGS. 7*a-c* show a top plan view of portions of several light strips 700, 720, 740 that may be used to mount multiple LEDs to the mount surface 506. Although LEDs are used as the light sources in various embodiments described herein, it is understood that other light sources, such as laser diodes for example, may be substituted in as the light sources in other embodiments of the present invention.

Many industrial, commercial, and residential applications call for white light sources. The light assembly 100 may comprise one or more emitters producing the same color of light or different colors of light. In one embodiment, a multicolor source is used to produce white light. Several colored light combinations will yield white light. For example, it is known in the art to combine light from a blue LED with wavelength-converted yellow (blue-shifted-yellow or "BSY") light to yield white light with correlated color temperature (CCT) in the range between 5000K to 7000K (often designated as "cool white"). Both blue and BSY light can be generated with a blue emitter by surrounding the emitter with phosphors that are optically responsive to the blue light. When excited, the phosphors emit yellow light which then combines with the blue light to make white. In this scheme, because the blue light is emitted in a narrow spectral range it is called saturated light. The BSY light is emitted in a much broader spectral range and, thus, is called unsaturated light.

Another example of generating white light with a multicolor source is combining the light from green and red LEDs. RGB schemes may also be used to generate various colors of light. In some applications, an amber emitter is added for an RGBA combination. The previous combinations are exemplary; it is understood that many different color combinations may be used in embodiments of the present invention. Several of these possible color combinations are discussed in detail in U.S. Pat. No. 7,213,940 to Van de Ven et al.

The lighting strips 700, 720, 740 each represent possible LED combinations that result in an output spectrum that can be mixed to generate white light. Each lighting strip can include the electronics and interconnections necessary to power the LEDs. In some embodiments the lighting strip comprises a printed circuit board with the LEDs mounted and interconnected thereon. The lighting strip 700 includes clusters 702 of discrete LEDs, with each LED within the cluster 702 spaced a distance from the next LED, and each cluster 702 spaced a distance from the next cluster 702. If the LEDs within a cluster are spaced at too great distance from one another, the colors of the individual sources may become visible, causing unwanted color-striping. In some embodiments, an acceptable range of distances for separating consecutive LEDs within a cluster is not more than approximately 8 mm.

The scheme shown in FIG. 7*a* uses a series of clusters 702 having two blue-shifted-yellow LEDs ("BSY") and a single red LED ("R"). Once properly mixed the resultant output light will have a "warm white" appearance.

The lighting strip 720 includes clusters 722 of discrete LEDs. The scheme shown in FIG. 7*b* uses a series of clusters 722 having three BSY LEDs and a single red LED. This scheme will also yield a warm white output when sufficiently mixed.

The lighting strip 740 includes clusters 742 of discrete LEDs. The scheme shown in FIG. 7*c* uses a series of clusters 742 having two BSY LEDs and two red LEDs. This scheme will also yield a warm white output when sufficiently mixed.

The lighting schemes shown in FIGS. 7*a-c* are meant to be exemplary. Thus, it is understood that many different LED combinations can be used in concert with known conversion techniques to generate a desired output light color.

FIG. 8 is a perspective view of the first end cap 110 of the lighting assembly 100. The end cap 110 is shown with the side cover 306 removed to expose electronics 802 which are mounted on a board 804. The electronics 802 are used to regulate the power to the light emitters and to control the brightness and color of the output light. The electronics 802 can also perform many other functions. The removable side cover 306 (not shown) provides access to the electronics 802, allowing for full testing during and after assembly. Such testing may be easily implemented using Pogo pins, for example. Once testing is finished the side cover 306 can be replaced to protect the electronics 802. The holes 304 on top of the end cap 110 provide additional top-side access to the electronics for a connection to an external junction box, for example. The board 804 is held place within the end cap 110 using tabs 806, although other means such as screws or adhesive may also be used. Because the first end cap 110 houses the electronics necessary to power/control the light emitters, the second end cap 112 (not shown in FIG. 8) may not contain any electronic components, allowing for a thinner profile. However, in some embodiments the second end cap 112 may contain additional electronics, batteries, or other components. The end cap 110 also includes space for the cable connectors 604, allowing for the lighting assembly 100 to be easily connected to another similar assembly as shown herein with reference to FIG. 9.

Figure 9:
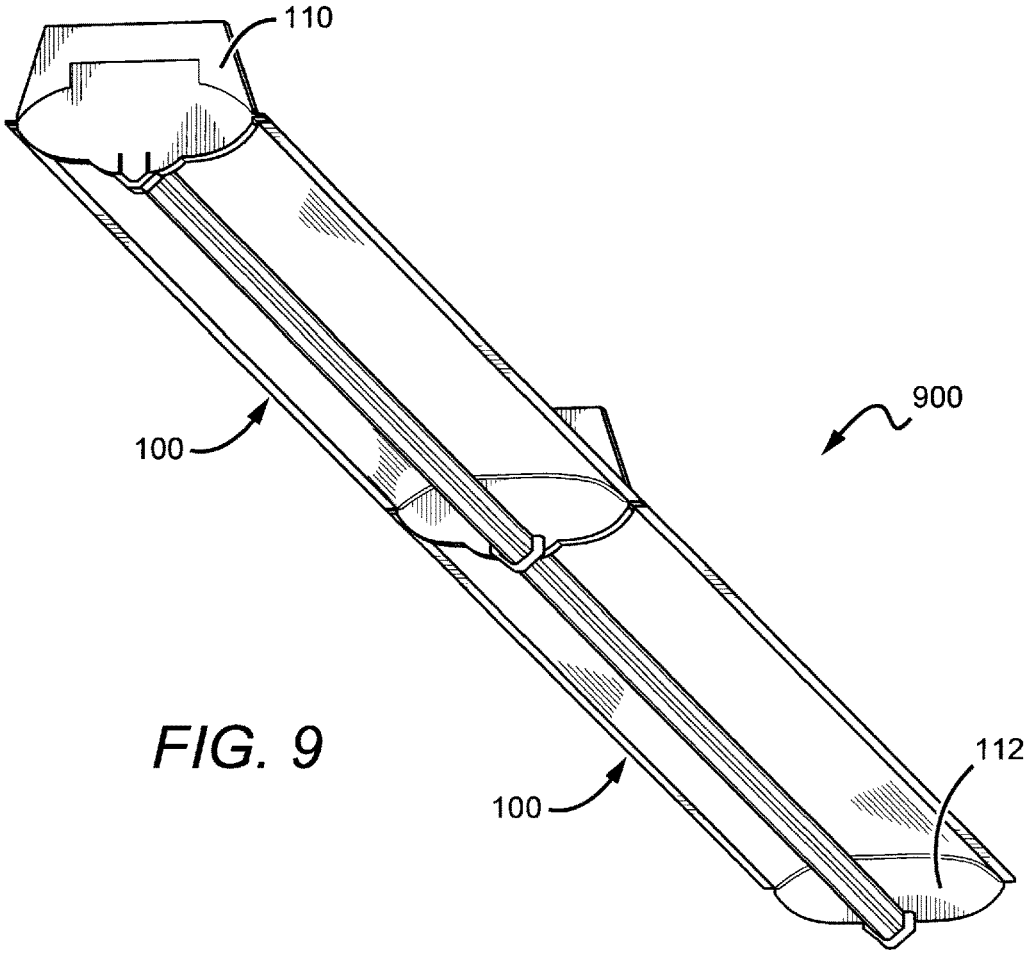
FIG. 9 is a perspective view of a modular lighting assembly according to an embodiment of the present invention.

FIG. 9 shows a perspective view of a modular lighting assembly 900 according to an embodiment of the present invention. Individual light assemblies (such as assembly 100) can be connected in an end-to-end serial (i.e., daisy chain) configuration. Each assembly 100 includes its own electronics 802 such that the individual assemblies 100 may be easily removed or added to the modular assembly 900 as needed. The assemblies 100 include connectors, such as cable connector 604 that allow for the serial connection. The connections between the assemblies 100 are made within the respective end caps 110 to protect the wired connections from outside elements. Respective first and second end caps can comprise snap-fit structures such that adjacent assemblies 100 may be easily connected, although other means may be used to connect adjacent assemblies. In one embodiment, the second end cap comprises snap-fit structures on two opposing surfaces to facilitate connection of adjacent assemblies 100. In another embodiment, both the first and second end caps 110, 112 comprise snap-fit structures on two sides.

The modular assembly 900 comprises two individual assemblies 100 as shown. In this particular embodiment, each assembly 100 is approximately 8 ft long. However, because the reflector 102 and heat sink 104 components can be fabricated by extrusion, the assemblies 100 can easily be scaled to a desired length. For example, other modular assemblies could comprise individual units having lengths of 2 ft, 4 ft, 6 ft, etc. Additionally, individual units of different lengths can be combined to construct a modular assembly having a particular size. For example a 2 ft unit can be connected to an 8 ft unit to construct a 10 ft modular assembly. This is advantageous when designing modular assemblies for rooms having particular dimensions. Thus, it is understood that the assemblies can have many different lengths. More than two of the assemblies can be connected to provide a longer series.

FIG. 10*a* is a cross-sectional view of another reflector that can be used in embodiments of the lighting assembly 100. In this particular embodiment, the reflector 150 comprises two different materials having different optical and structural properties and different relative costs. Similarly as the reflector 102, the reflector 150 comprises a surface 152 and a back surface 154. In one embodiment, the reflector 150 comprises a first light-transmissive base material 156 (e.g., a polycarbonate) which provides the basic structure of the device. At least a portion of the surface 152 comprises a second highly reflective material 158. The two materials 156, 158 can be coextruded for more convenient and cost-efficient fabrication of the reflector 150. For example, a cheaper bulk material may be used as the base material 152, requiring a smaller amount of the more expensive reflective material 154 to manufacture the reflector 150.

The base material 156 provides structural support to the reflector 150 and allows for transmission through areas of the surface 152 where the reflective material 158 is very thin or non-existent. For example, the reflector 150 comprises transmissive windows 160 where little to no reflective material is disposed. FIG. 10*b* is a close-up view of a portion of the reflector 150 showing one such window. These windows 160 allow light to pass through them, providing uplight (i.e., light emitted from the back surface 154 of the reflector 150). The amount of uplight generated by the reflector 150 can be varied by regulating the thickness of reflective material 158 and/or the size and frequency of the windows 160 across the surface 152. Desired transmissive and reflective effects may be achieved using a non-uniform distribution of the reflective material 158 across the surface 152.

It is understood that embodiments presented herein are meant to be exemplary. Embodiments of the present invention can comprise any combination of compatible features shown in the various figures, and these embodiments should not be limited to those expressly illustrated and discussed.

Although the present invention has been described in detail with reference to certain preferred configurations thereof, other versions are possible. Therefore, the spirit and scope of the invention should not be limited to the versions described above.

We claim:

1. A lighting assembly, comprising:

an elongated heat sink comprising a body, said body comprising a mount surface and a hollow interior that defines a conduit through said body, said conduit completely surrounded by said body and running in a longitudinal direction through an interior of said body;

an electrical conductor at least partially located in said conduit;

a reflector over said heat sink, said reflector comprising a reflective surface facing said mount surface and said heat sink, wherein said reflective surface has a width larger than said heat sink; and a first end cap, said heat sink and said reflector mountable to said end cap, wherein said first end cap maintains a distance between said reflector and said heat sink.

2. The lighting assembly of claim 1, said reflector further comprising a back surface comprising first and second rails running longitudinally along said back surface, said first and second rails providing mechanical support for said reflector.

3. The lighting assembly of claim 2, said first and second rails comprising an inner flange along an inside surface of said first and second rails.

4. The lighting assembly of claim 3, said inner flange shaped to cooperate with a U-shaped mount bracket configured to be mounted to a ceiling.

5. The lighting assembly of claim 2, said first and second rails comprising an outer flange along an outside surface of said first and second rails.

6. The lighting assembly of claim 5, said outer flange shaped to cooperate with mount tongs that extend down from a ceiling.

7. The lighting assembly of claim 1, wherein said first end cap houses electronics for powering light emitters.

8. The lighting assembly of claim 7, wherein said electronics are accessible for testing when said first end cap is mounted to said reflector and said heat sink.

9. The lighting assembly of claim 1, further comprising a second end cap, said first and second end caps comprising snap-fit structures such that said heat sink and said reflector are mountable between said first and second end caps.

10. The lighting assembly of claim 9, wherein said second end cap further comprises mount structures on both sides such that said second end cap may be connected to an additional end cap or an additional reflector on either side.

11. The lighting assembly of claim 1, wherein said reflector comprises an extruded material having high optical reflectivity.

12. The lighting assembly of claim 1, wherein said heat sink comprises an extruded material having high thermal conductivity.

13. The lighting assembly of claim 1, wherein said reflector comprises a base material and a reflective material.

14. The lighting assembly of claim 13, wherein said reflective material is distributed across said reflective surface such that said reflector comprises transmissive windows that allow light to pass through said reflector and out a back surface of said reflector to provide uplight.

15. The lighting assembly of claim 13, wherein said reflective material is distributed non-uniformly across said reflective surface.

16. A modular lighting assembly, comprising:

at least one lighting unit capable of being connected to additional lighting units in an end-to-end serial arrangement, said at least one lighting unit comprising:

an elongated heat sink comprising a mount surface;

a plurality of light emitters on said mount surface;

a reflector comprising a reflective surface facing said heat sink and a back surface comprising first and second rails running longitudinally across said back surface;

a first end cap; and a second end cap;

wherein said heat sink and said reflector extend between and are separately releasably mounted to said first end cap and said second end cap, said first and second end caps maintaining a distance between said reflector and said heat sink such that said heat sink is entirely below said reflector, and wherein said heat sink, said reflector, and said first and second rails are between said first end cap and said second end cap, wherein at least one of said first and second rails is configured to engage with at least one of said first and second end caps.

17. The modular lighting assembly of claim 16, wherein a plurality of said at least one lighting unit are connected in an end-to-end serial arrangement.

18. The modular lighting assembly of claim 17, wherein each of said plurality of said at least one lighting unit further comprises electronics within said first end cap for providing power to light emitters.

19. The modular lighting assembly of claim 18, wherein said electronics in each of said plurality of said at least one lighting unit are accessible for testing when said lighting units are connected.

20. The modular lighting assembly of claim 16, said heat sink shaped to define a conduit running longitudinally through the interior of said heat sink, wherein said heat sink is configured to house electrical conductors.

21. The modular lighting assembly of claim 16, said first and second rails each comprising an inner flange along an inside surface of said first and second rails.

22. The modular lighting assembly of claim 21, said inner flange shaped to cooperate with a U-shaped mount bracket mounted to a surface.

23. The modular lighting assembly of claim 16, said first and second rails comprising an outer flange along an outside surface of said first and second rails.

24. The modular lighting assembly of claim 23, said outer flange shaped to cooperate with mount tongs that extend down from a surface above said lighting assembly.

25. The modular lighting assembly of claim 16, said first and second end caps comprising snap-fit structures such that said heat sink and said reflector are mounted with a snap-fit connection between said end caps.

26. The modular lighting assembly of claim 16, wherein said reflector comprises an extruded material having high optical reflectivity.

27. The modular lighting assembly of claim 16, wherein said heat sink comprises an extruded material having high thermal conductivity.

28. The modular lighting assembly of claim 16, said second end cap comprising mount structures on two opposing surfaces.

29. A lighting assembly, comprising:

an elongated heat sink comprising a mount surface, said heat sink surrounding a conduit extending in a longitudinal direction through said heat sink;

a plurality of light emitters on said mount surface and over said conduit;

an electrical conductor running through said conduit in the longitudinal direction to provide power to said light emitters;

a reflector comprising a reflective surface facing toward said light emitters and said heat sink, wherein said reflective surface has a width larger than said heat sink; and first and second end caps comprising mount structures such that said heat sink and said reflector extend between and are separately releasably mounted to said first and second end caps, said first and second end caps maintaining a distance between said reflector and said heat sink such that said heat sink is entirely below said reflector, said first end cap housing electronics for powering said light emitters, said reflector further comprising a back surface comprising first and second rails running longitudinally along said back surface and configured to engage said first and second end caps.

30. The lighting assembly of claim 29, said first and second rails providing mechanical support for said reflector.

31. The lighting assembly of claim 30, said first and second rails comprising an inner flange along an inside surface of said first and second rails.

32. The lighting assembly of claim 31, said inner flange shaped to cooperate with a U-shaped mount bracket configured to be that can be mounted to a ceiling.

33. The lighting assembly of claim 30, said first and second rails comprising an outer flange along an outside surface of said first and second rails.

34. The lighting assembly of claim 33, said outer flange shaped to cooperate with mount tongs that extend down from a ceiling.

35. The lighting assembly of claim 29, wherein said electronics are accessible for testing when said end cap is mounted to said reflector and said heat sink.

36. The lighting assembly of claim 29, wherein said second end cap further comprises mount structures on both sides such that said second end cap may be connected to an additional end cap or an additional reflector.

37. The lighting assembly of claim 29, wherein said reflector comprises an extruded material having high optical reflectivity.

38. The lighting assembly of claim 29, wherein said heat sink comprises an extruded material having high thermal conductivity.

39. The lighting assembly of claim 29, wherein said plurality of light emitters are aimed to emit toward said surface.

40. The lighting assembly of claim 29, wherein at least a portion of said reflector comprises a reflective material and a base material.

41. The lighting assembly of claim 40, wherein said reflective material is distributed across said reflective surface such that said reflector comprises transmissive windows that allow light to pass through said reflector and out of said reflector to provide uplight.

42. The lighting assembly of claim 40, wherein said reflective material is distributed non-uniformly across said reflector.

* * * * *